US005149913A

United States Patent [19]

Arakaki

[11] Patent Number: 5,149,913

[45] Date of Patent: Sep. 22, 1992

[54] FORCED EXPANDING BULLET

[76] Inventor: Steven Y. Arakaki, 927 Laki Rd., Honolulu, Hi. 96817

[21] Appl. No.: 577,671

[22] Filed: Sep. 5, 1990

[51] Int. Cl.[5] ..... F42B 12/34

[52] U.S. Cl. ..... 102/506; 102/509; 102/517

[58] Field of Search ..... 102/501, 506–511, 102/517, 518, 525

[56] References Cited

U.S. PATENT DOCUMENTS

| | | | |
|---|---|---|---|
| 40,153 | 10/1863 | Billings | 102/511 |
| 44,492 | 2/1864 | Williams | 102/525 |
| 90,732 | 6/1969 | Curtis . | |
| 216,974 | 7/1979 | Rice . | |
| 724,326 | 3/1903 | Pepperling . | |
| 1,017,928 | 2/1912 | Tocik . | |
| 1,023,469 | 4/1912 | Haslett . | |
| 1,322,662 | 11/1919 | Watson | 102/510 |
| 1,493,614 | 5/1924 | Dickerman | 102/510 |
| 2,324,678 | 7/1943 | Clark . | |
| 3,103,889 | 9/1963 | Keeney, Sr. . | |
| 3,138,102 | 6/1964 | Meyer et al. | 102/506 |
| 3,672,304 | 6/1972 | Rogers et al. . | |
| 3,861,311 | 1/1975 | Bilsbury . | |
| 4,048,922 | 9/1977 | Buljovcic . | |
| 4,136,616 | 1/1979 | Schuneker | 102/507 |
| 4,245,557 | 1/1981 | Kanppworst et al. . | |
| 4,301,737 | 11/1981 | Yuhash et al. . | |
| 4,665,827 | 5/1987 | Ellis, II . | |
| 4,779,535 | 10/1988 | Maki . | |
| 4,788,915 | 12/1988 | Sauvestre | 102/506 |
| 4,879,953 | 11/1989 | Carter | 102/507 |
| 4,895,077 | 1/1990 | Miethlich et al. . | |
| 4,947,755 | 8/1990 | Burczynski | 102/506 |
| 4,977,834 | 12/1990 | Denis | 102/507 |

FOREIGN PATENT DOCUMENTS

| | | | |
|---|---|---|---|
| 60850 | 2/1892 | Fed. Rep. of Germany | 102/507 |

*Primary Examiner*—Harold J. Tudor

*Attorney, Agent, or Firm*—James Creighton Wray

[57] ABSTRACT

The expanding bullet assembly incorporates a bullet head which incorporates an axial borehole extending from the rear of the bullet head towards the tip but not reaching the tip. The bullet head can incorporate longitudinal serrations or grooves and/or circumferential grooves which aid in separation upon impact. The borehole receives a shaft made of brass, copper or other metal harder than the leaden bullet. The shaft (or pin) extends from the back of the bullet and is connected to an inertial fragmenter, which is separated somewhat from the bullet head. The fragmenter can have tapered or sloped sides adjacent the back of the bullet for wedging into and forcing apart the fragments of the bullet. The bullet head can be round, pointed or hollow pointed. The shaft end near the bullet tip can alternatively be an integral expanded shaft tip having the shape of a sphere. Upon impact of the bullet head, the fragmenter slams into the back of the bullet causing the shaft portion to be forced towards the tip and forcing the bullet apart into fragments.

8 Claims, 2 Drawing Sheets

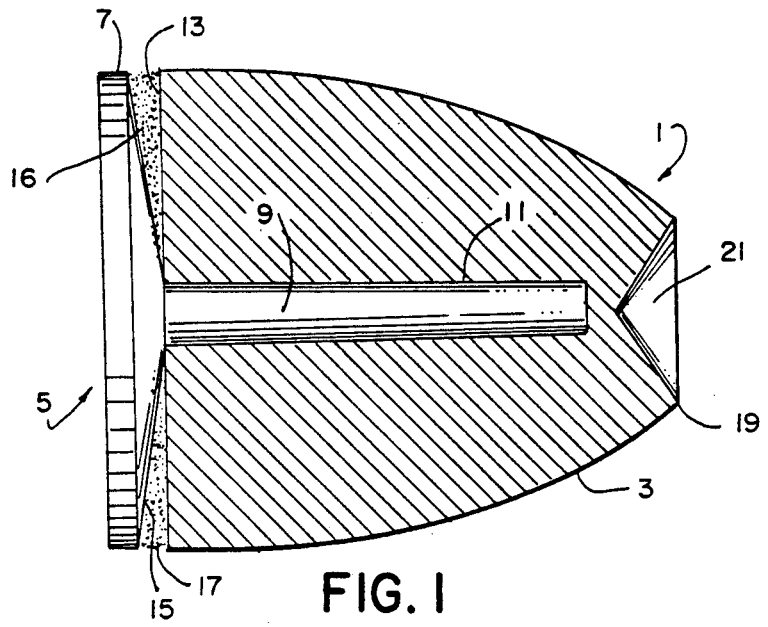
FIG. 1
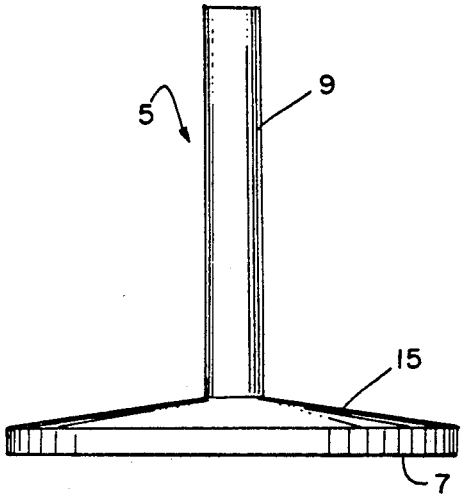
FIG. 2
FIG. 3
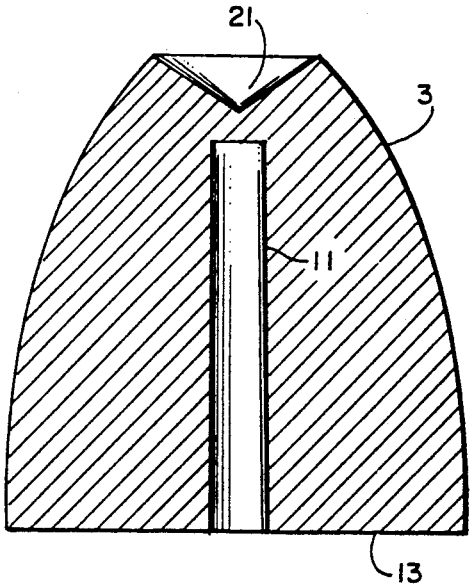

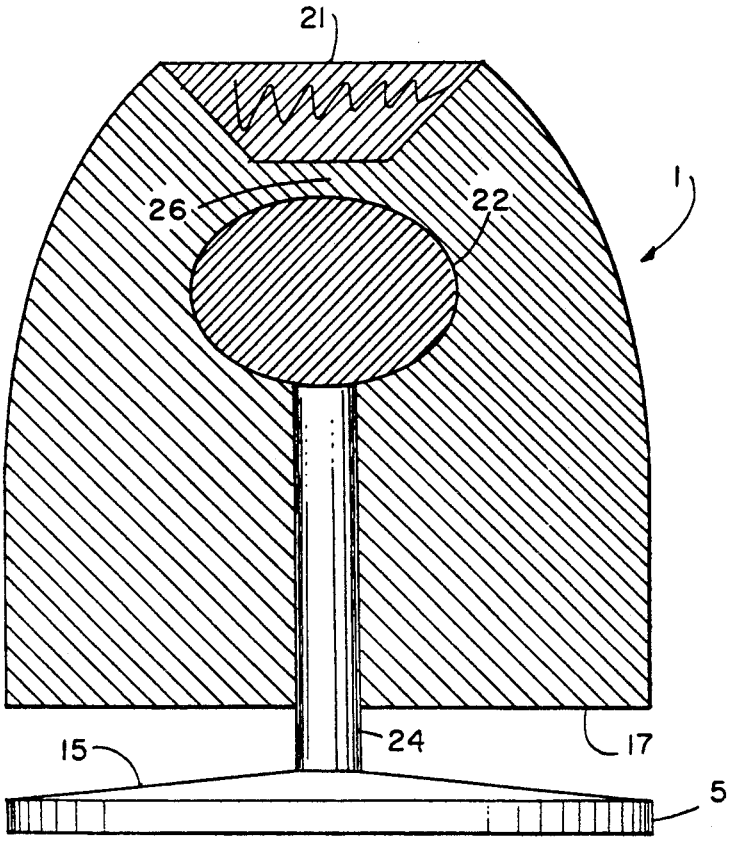
FIG. 4
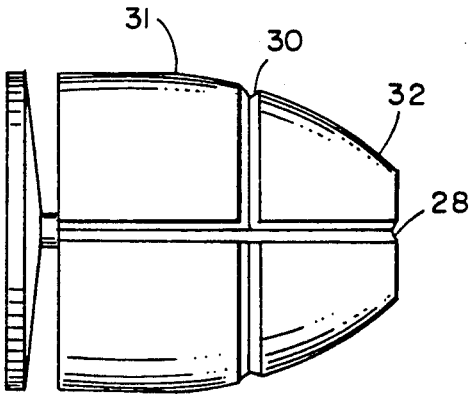
FIG. 5
FIG. 6
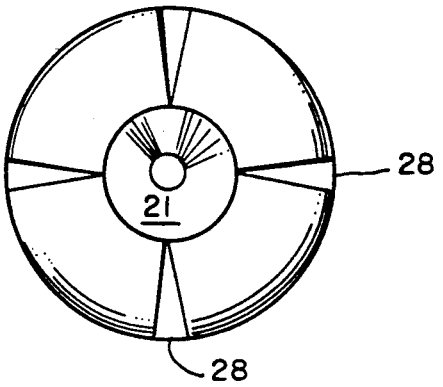

FORCED EXPANDING BULLET

BACKGROUND OF THE INVENTION

The present invention relates to fragmentable bullets, more specifically, fragmentable bullets for firearms of all calibers, for usage in hunting, warfare and police enforcement.

It is known to provide fragmenting bullets for increased damage to a target in the field of hunting, law enforcement or warfare. Fragmenting bullets provide multiple damage paths, and further the spreading of the fragments increases the chances of hitting a target. The multiple pellets of a shotgun constitute an illustration of this knowledge. During hunting or wartime situations, targets are often moving and maximum damage per bullet is desired. Therefore, there is a need for accurate fragmentable bullets or missiles. The present invention addresses this need.

Simple fragmentable projectiles are long known in the art.

U.S. Pat. No. 216,974 is an old patent having a rear portion B consisting of a cylindrical body and a cone-shaped forward portion, and a head portion provided with a truncated rear complementary to the cone. The head portion is segmented or serrated so that, upon impact, the cone portion pushes into the truncated rear portion to split the segmented head and provide multiple projectiles.

U.S. Pat. No. 90,732 is an older patent describing longitudinal and horizontal slots within a bullet for allowing fragmentation of a bullet.

More recent patents show greater sophistication of small arms bullets.

U.S. Pat. No. 4,048,922 is a self-fragmentable bullet having hollow point hollow core weakened zones along a head portion and a sloping base portion separated from the head portion by an outer core of reduced diameter. The invention is not provided with a piston which causes fragmentation of the bullet through forward inertia of the base portion upon the retarded head portion.

The use of center core members of differing materials is also known to the art.

U.S. Pat. No. 4,301,737 is a kinetic energy projectile incorporating a hardened core 12, fragmenter discs 14 and a pusher disc 22 displaced behind the core. The penetrator core hits and pierces armor, while the pusher disc aids in penetration and also causes the front edges of the fragmenting discs to impact the armor and subsequently scatter to act as antipersonnel projectiles.

U.S. Pat. No. 4,245,557 shows a projectile provided with a front insert of different material than the projectile body. The front tip of the projectile body is truncated, and an axial borehole is drilled substantially therefrom into the projectile. The insert mates with the cone and part of the borehole. Upon impact, the insert of hard material is pushed into the body of more malleable material through the borehole and mushrooms or fragments the projectile.

Other patents show the use of inertial members for fragmentation.

U.S. Pat. No. 4,779,535 is a slug provided with a plunger for stabilizing the slug within the barrel.

Most bullets of the type described above fragment upon impact. The present invention incorporates a central inertial member to fragment the bullet, and further work in conjunction with bullet head design to increase the effectiveness of fragmentable bullets.

SUMMARY OF THE INVENTION

The bullet of the present invention is designed to either fracture or mushroom within the barrel or upon impact. It is different from other bullets because upon firing a pin is driven up the center of the bullet. This pin causes the front of the bullet to either start fracturing or enlarging the frontal cavity. Drag from the sides of the barrel further weakens the solidity of the bullet, causing partial or full fragmentation. Upon impact the bullet is expanded by the material of the target pushing into the front cavity of the bullet. The bullet and pin may separate, resulting in multiple wound paths.

The bullet consists of an inertial plunger and a bullet head. The plunger incorporates a base and a perpendicularly projecting pin. The pin is preferably a rod-like impactor which is inserted during manufacture into an axial borehole in the back of the bullet head. Upon firing, the head and plunger impact when the pin reaches the full depth of the borehole. An expanded tip can be added to the end of the plunger pin proximal the end of the hole. This causes the frontal area of the bullet to deform, and subsequently the remainder of the bullet head to fracture.

The pin is made for either brass or copper, though similarly hard metals can be used. Magnetized material can also be used in the pin for use in electromagnet guns. The frontal face of the plunger base is sloped to aid the fracturing of the bullet when the base impacts the rear of the bullet. A gap between the bullet and the base of the pin can be filled with a lubricant, but care must be taken so that the lubricant does not hinder the movement of the plunger. The plunger is pushed into the bullet by the high pressure gases from the gunpowder.

In all the drawings the pin is shown with a flat point. A pointed tip can be used if needed.

The bullet itself is shown with a hollow point. This is to improve deformation of the bullet during initial and terminal impact. A round nose bullet can be used with modifications in material, velocity of the bullet and pin design. The material for the bullet is lead, possibly with some alloy in it, and with or without a copper or metal jacket. It can also be heat treated. Serrations can also be added to the bullet. The serrations will aid in the deformation or fragmenting of the bullet. Circumferential and longitudinal grooves or serrations are shown.

The preferred expanding bullet assembly comprises a bullet head, a plunger and an axially movable attachment therebetween. The bullet head is made of a deformable material for mushrooming and fragmenting. The axial borehole extends within the head from the rear portion of the head towards the front tip of the head, said borehole being complementary to the pin portion of the plunger.

The plunger incorporates the base portion and the axially protruding pin of greater length but lesser circumference than the base. The pin extends substantially inward from the rear of the bullet head towards the tip of the bullet head.

An inertial plunger impacts the rear of the bullet head and end of the axial borehole to fragment and mushroom the bullet head. Preferably the base portion resembles a disc with the pin perpendicularly protruding from the center of the disc.

The base portion has a sloped face where the pin and base join, thereby causing a gap to be formed between the rear face of the bullet head and the front face of the base when the bullet is assembled. A lubricant can be provided in the gap between the rear face of the bullet head and the front face of the plunger base. In a preferred embodiment, the perpendicularly protruding pin is a cylindrical rod nearly as long as the head of the bullet.

An expanded pin-tip portion can be included opposite the juncture with the base, with the expanded tip embedded in the bullet head.

The axial borehole extends from the rear portion for fitting the plunger pin, and a frontal cavity increases mushrooming and separation of the bullet head.

A longitudinally extending groove can be incorporated on the outer surface of the bullet head. Circumferential grooves can also be provided on the outer surface of the bullet head for further sectioning the fragmenting bullet. The grooves prescribe fragment sections for the impacted bullet.

The pin is substantially the same length as the borehole, and the front face of the base portion abuts the rear face of the bullet head.

The expanding bullet assembly further comprises the attachment between the plunger pin and bullet head, wherein the movability of the pin within the borehole can be calibratable during manufacture for varying the fragmentation of the bullet.

The expanding bullet assembly incorporates a bullet head which incorporates an axial borehole extending from the rear of the bullet head towards the tip but not reaching the tip. The bullet head can incorporate longitudinal serrations or grooves and/or circumferential grooves which aid in separation upon impact. The borehole receives a shaft made of brass, copper or other metal harder than the leaden bullet. The shaft (or pin) extends from the back of the bullet and is connected to an inertial fragmenter, which is separated somewhat from the bullet head. The fragmenter can have tapered or sloped sides adjacent the back of the bullet for wedging into and forcing apart the fragments of the bullet. The bullet head can be round, pointed or hollow pointed. The shaft end near the bullet tip can alternatively be an integral expanded shaft tip having the shape of a sphere. Upon impact of the bullet head, the fragmenter slams into the back of the bullet causing the shaft portion to be forced towards the tip and forcing the bullet apart into fragments.

These and further and other objects and features of the invention are apparent in the disclosure, which includes the above and ongoing written specification, with the claims and the drawings.

BRIEF DESCRIPTION OF THE DRAWINGS

FIG. 1 is a cutaway side view of the assembled expanding bullet with hollow point tip.

FIG. 2 is a side view of the plunger assembly.

FIG. 3 is a cutaway side view of the bullet head.

FIG. 4 is a cutaway side view of an alternate embodiment having an expanded plunger pin tip.

FIG. 5 is a side view showing the longitudinal and circumferential grooves on the bullet head.

FIG. 6 is a front view of the bullet head showing hollow point tip and longitudinal serrations.

DETAILED DESCRIPTION OF THE DRAWINGS

As shown in FIG. 1 the expanding bullet assembly, generally referred by the numeral 1, incorporates a bullet head 3 and an inertial plunger 5. In one embodiment, plunger 5 has a base portion 7 and a perpendicularly protruding pin 9. The bullet head has an axial borehole 11 drilled into the rear face 13. A front face 15 of the plunger base is frusto-conical and sloped generally outward towards the pin projection 9. The angle of the slope can vary according to desired fragmenting qualities of the plunger and can be specified during manufacture. A gap 17 is left between the base portion and bullet head. A special lubricant 16 may be provided therein to assist in the forward movement of the plunger into the bullet head. The bullet head is provided with a front tip 19. In a preferred embodiment, a cavity 21 is incorporated into the front tip to make the expanding bullet a conventional, hollow-tipped bullet.

FIGS. 2 and 3 show the non-assembled bullet. The plunger 5, comprised of base 7 and pin 9, has a sloping front face 15. Alternatively, the front face of the base may be flat or provided with other shapes such as raised, sloped dividers to assist in the inertial separation during impact. The plunger can be made from brass or copper, or other similarly hard materials can be specified during manufacture. The pin is preferably a cylindrical rod having a length substantially as long as the bullet head. Alternate embodiments provide expanded tips on the end of the pin, as shown in FIG. 4. In the preferred embodiment, the diameter of the circular base portion coincides with the diameter of the rear face of the bullet head. However, varying the size relationships of the bullet head and base portions is not beyond the scope of the invention.

As shown in FIG. 3, the bullet head 3 incorporates an axial borehole 11 for fitting the pin 9 in FIG. 2. It is preferred that the borehole extend to nearly the front of the bullet head. In the FIG. 3 embodiment, the borehole extends through the bullet head almost to the forward cavity 21, which substantially weakens the center portion of the bullet to assist in fragmentation. Upon impact of the front portion of the bullet, the forward cavity traps air which causes a mushrooming effect. During firing and impact the pin pushes forward to meet the cavity, and the sloped base pushes into the rear face 13 of the bullet head to assist in fragmentation. The mushrooming and fragmentation of the bullet head widens the kill area and causes further destruction of the target. The less malleable plunger follows the bullet head into the target, the stiff pin 9 penetrating like a dart.

Depending on plunger placement, lubricant and movability of the plunger with respect to the bullet head, the assembly is calibrated so that fragmentation will occur upon firing of the bullet. This is desirable in closer range situations. Fragmentation would occur within the barrel of the gun because of the internal forward action of the plunger and the simultaneous external drag from the sides of the barrel. Upon exiting the barrel, the fragments would spread out with the plunger immediately following. This would cause multiple wound paths on the target and would effectively increase the changes of hitting a target.

In FIG. 4, expanded pin tip 22 would further assist in the fragmentation of the bullet. In this embodiment, unrestricted pin portion 24 adjacent the base portion would allow for increased movement between the base 5 and the rear face 17 of the bullet head during firing. The unrestricted pin portion 24 is longer than the bullet head portion 26 immediately in front of the pin tip 22. Therefore, the initial forward movement of the pin, as prescribed by the length of the unrestricted portion 24, causes the pin tip 22 to enter the bullet head cavity 21. This would cause a pre-flight fragmentation of the bullet to enhance close range performance of the bullet. The sloped front face 15 of the base portion further enhances the fragmenting capabilities of the plunger. Also, the expanded pin tip serves as a separate projectile. In FIG. 4, the tip 22 is of spherical construction. However, other shapes, such as pyramidal or pointed structures, can be incorporated with the same effect. The tip 22 can be of the same material and integrally formed with the remainder of the plunger, or alternatively can be of a harder or more malleable material determined during manufacture. It is not beyond the scope of the present invention for the tip 22 to be a hollow canister.

FIGS. 5 and 6 show external views of a preferred embodiment of the bullet head assembly. Side view FIG. 5 shows longitudinal grooves or serrations 28 and circumferential grooves or serrations 30, which would assist in fragmenting of the bullet. Separate fragments 31 and 32 are prescribed by the serration, the number of which can be varied according to the size of the bullet, desired range requirements, etc. Frontal view FIG. 6 shows the bullet head cavity 21 and radial, longitudinal serrations 28 dividing the bullet into quadrants of separate fragments. Although circumferential and longitudinal serrations are shown, other serration patterns are not beyond the scope of the present invention. For example, spiral serrations would aid in rifling of the bullet for higher accuracy in longer flights. Upon impact, these serrations would allow for similar fragmentation, as described above.

While the invention has been described with reference to specific embodiments, modifications and variations of the invention may be constructed without departing from the scope of the invention, which is defined in the following claims.

I claim:

1. An expanding bullet assembly, comprising a bullet head, a plunger and an axially movable attachment therebetween;

the bullet head further comprising a deformable material for mushrooming and fragmenting, wherein an axial borehole extends within the head from a substantially flat rear face of the head substantially to a front tip of the head, said borehole being complementary to a pin portion of the plunger;

the plunger further comprising a base portion having a frusto-conical front face for engaging the substantially flat rear face of the head and a perpendicularly protruding pin from the frusto-conical front face of the base portion thereby forming a gap between the substantially flat rear face of the bullet head and the frusto-conical front face of the base portion;

an axially movable attachment between the plunger and the bullet head, wherein the pin extends axially inward from the substantially flat rear face of the bullet head substantially to the tip of the bullet head within the borehole and completely fills the borehole; and the bullet head further comprising a frontal cavity comprising a circumferential wall sloping from a generally central point of the bullet head to a circumferential edge of the front tip of the bullet head.

2. The expanding bullet assembly of claim 1, wherein a lubricant is provided in the gap between the substantially flat rear face of the bullet head and the frusto-conical front face of the base portion.

3. The expanding bullet assembly of claim 1, further comprising the perpendicularly protruding pin being a cylindrical rod.

4. The expanding bullet assembly of claim 1, further comprising at least one longitudinally extending groove on an outer surface of the bullet head, said groove prescribing fragmented sections for an impacted bullet.

5. The expanding bullet assembly of claim 1, further comprising at least one circumferential groove provided on an outer surface of the bullet head for sectioning a fragmenting bullet.

6. The expanding bullet assembly of claim 1, wherein the bullet head is comprised of a malleable metal and the plunger is of a harder metal.

7. The expanding bullet assembly of claim 1, wherein the material of the pin is brass.

8. The expanding bullet assembly of claim 6, wherein the material of the pin is copper.

* * * * *